US008350484B2

(12) United States Patent
Stanley

(10) Patent No.: US 8,350,484 B2
(45) Date of Patent: Jan. 8, 2013

(54) PUSH BUTTON SWITCH

(76) Inventor: Oliver Conrad Stanley, Rio Rancho, NM (US)

( * ) Notice: Subject to any disclaimer, the term of this patent is extended or adjusted under 35 U.S.C. 154(b) by 56 days.

(21) Appl. No.: 13/066,722

(22) Filed: Apr. 22, 2011

(65) Prior Publication Data

US 2012/0268035 A1 Oct. 25, 2012

(51) Int. Cl.
*H05B 41/00* (2006.01)
*H01H 1/52* (2006.01)

(52) U.S. Cl. ..... 315/193; 200/314

(58) Field of Classification Search ..... 315/127, 315/193, 362, 307, 291, 308; 200/308, 310, 200/311, 312, 314, 317, 318.1, 302.2, 341, 200/51.16
See application file for complete search history.

(56) References Cited

U.S. PATENT DOCUMENTS 2,268,872 A 1/1942 Hewlett
4,298,869 A 11/1981 Okuno
5,278,362 A * 1/1994 Ohashi ..... 200/5 A
6,310,308 B1 * 10/2001 Watson et al. ..... 200/520
7,060,922 B2 * 6/2006 Hoehne et al. ..... 200/314
RE40,125 E * 3/2008 Matthews et al. ..... 200/4

OTHER PUBLICATIONS

Prentice Hall pp. 247-275 ISBN 0-13-066102-3 (2004).

* cited by examiner

*Primary Examiner* — Douglas W Owens
*Assistant Examiner* — Minh D A

(57) ABSTRACT

A push button switch for use in logic-level switching applications. It has dual-intensity LED backlighting of a display: the switch off-state is low intensity and the on-state is distinctly brighter. The button assembly, not attached to the main body, uses magnets to provide a tactile touch and a retaining force. The backlight power is inductively coupled to the button assembly by a high-frequency oscillator that also limits and controls the LED backlight current. Switching is by a Hall-effect switch; alternate action is by bistable logic; and diode logic provides single-wire switch output and remote-control input. The wire can also carry remotely generated pulse signals to program an alternative active display. There are no mechanisms or wear parts in the assemblies, allowing impregnation sealing.

14 Claims, 3 Drawing Sheets

SECTION I - I

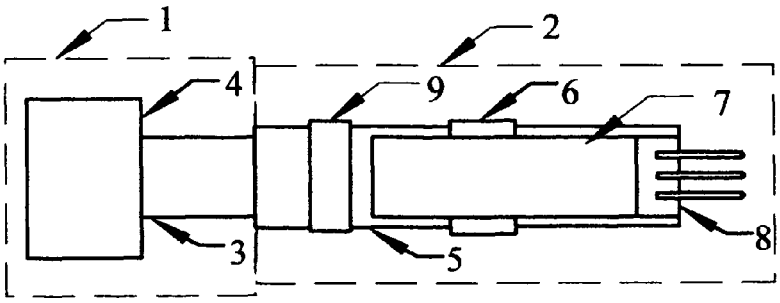
FIG. 1 TOP VIEW
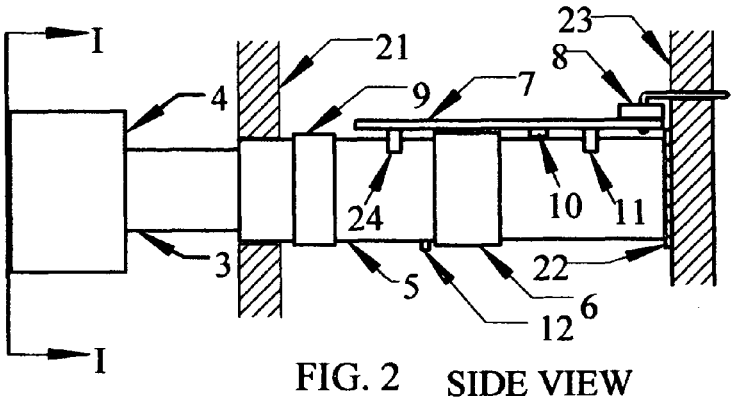
FIG. 2 SIDE VIEW
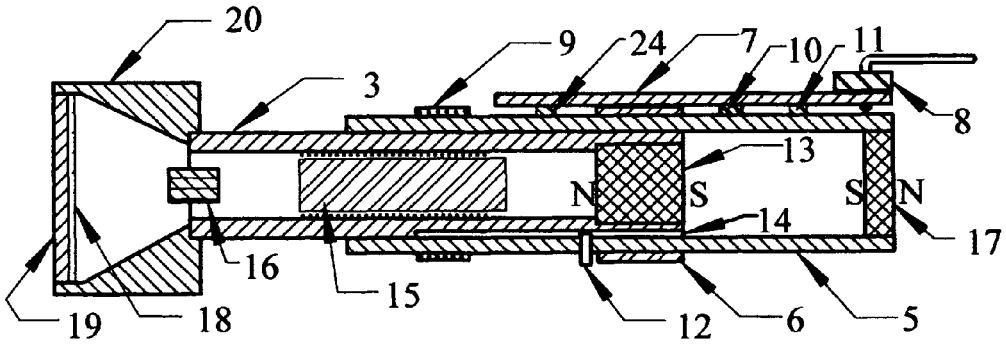
FIG. 3 SECTION I - I

PUSH BUTTON SWITCH

CROSS-REFRENCETO RELAETED APPLICATIONS

Not Appliacable

STATEMENT REGARDING FEDERALLY SPONSORED RESEARCH AND DEVELOPMENT

Not Appliacable

REFERENCES TO SEQUENCE LISTING, A TABLE, OR A COMPUTER PROGRAM LISTING COMPACT DISC APPENDIX

Not Appliacable

BACKGROUND OF THE INVENTION

1. Field of the Invention

The present invention relates to push button switches, particularly relating to instrumentation, control, or similar applications where the switched current and voltage are intended for operating electronic logic devices, and such switches may also include backlighting of a label or symbol located in or on the button face, and may also include an active display medium to provide messaging.

2. Prior Art

Current art and technology provide many forms of push button switches which are mechanical assemblies using springs and other mechanical parts. The switch assembly may include mechanical means of alternate action (push-on/push-off) thus complicating the switch fabrication and reducing its reliability. Also, various switch display media and controls generally require additional wiring. Elaborate seals may be required when the application requires operation subject to a hostile environment.

BRIEF SUMMARY OF THE INVENTION

It is the objective of the present invention to provide a push button switch assembly that: is low cost to produce; is extremely reliable; has no metal contacts or mechanical wear parts; has a dual intensity backlight to indicate ON/OFF state; has remote control of ON/OFF state; can be environmentally sealed by coatings or impregnation; has a passive display medium; or may include an active display medium (Electroluminescent Display).

The present invention is embodied in two main elements: (1) A push button assembly with an induction-powered backlight display, a permanent magnet , or an optional active display medium; (2) A stationary cylinder assembly with a permanent magnet, an electronic circuit board with a connector, a primary coil winding, and a ferromagnetic ring.

The present invention is embodied in two main elements: (1) A push button assembly with an induction-powered backlight display, a permanent magnet, and an optional active display medium; (2) A stationary cylinder assembly with a permanent magnet, an electronic circuit board with a connector, a primary coil winding, and a ferromagnetic ring.

The push button assembly is inserted into and moves freely within the cylinder assembly and is retained therein by its permanent magnet being attracted to a ferromagnetic ring which is a part of the the cylinder assembly. This configuration also provides a tactile resistance to depressing the push button.

The polarity of the cylinder assembly magnet is in opposition to the polarity of the push button assembly magnet, providing an increasing magnetic resistance force to limit piston travel into the cylinder and to return the push button assembly to a magnetically stable resting position when the push button is released.

The cylinder assembly circuit board contains electronic components soldered to the board in the conventional manner. It performs two functions:

(1) ON/OFF switch function. A common bistable logic circuit alternates its output state whenever it is triggered by an input pulse, thus providing alternate action switching. The input pulse may be provided by either of two means:

(a) A Hall-effect solid state device outputs an electrical pulse when the magnetic field of the push button assembly magnet is altered by depressing the push button.

(b) An external pulse is applied to the input/output connection by a remote controller. An optional active display medium in the push button assembly can be programmed by applying a serial pulse modulated signal to the input/output connection. One-wire data-output/control-input is a novel feature of the present invention.

(2) Dual intensity backlight power and control. A novel feature of the present invention is the means of providing power to light emitting diodes (LEDs) in the push button assembly or power and control to an optional active display medium in the push button assembly.

A low-power oscillator (power source) with the primary coil of its resonant circuit wound on the cylinder body electromagnetically couples power to a coil contained within the push button assembly.

The push button assembly coil is configured to intercept the electromagnetic field of the power source primary coil throughout the travel distance of the push button, thus providing a steady coupling of power during depression of the push button.

The coil in the push button assembly and the LEDs are electrically interconnected to provide the power for the LEDs. An optional display medium receives power and control from the coil.

A low power oscillator power source is a preferred embodiment of the present invention due to low cost, small size, and the ability to couple pulse modulation control signals to the push button assembly.

A resistor in the power source oscillator circuit is in series with the primary coil resonant circuit while the switch is OFF, reducing the current in the primary coil and reducing the power available to couple to the LEDs.

The resistor is bypassed by a transistor which conducts when the switch is ON, increasing the current in the primary coil and the power available to couple to the LEDs.

The illumination intensity difference between ON and OFF states is readily visible to indicate switch state.

The lower backlight intensity while the switch is OFF is sufficient to improve the push button backlighted display contrast ratio in all normal ranges of ambient lighting when compared with no backlighting. The dual intensity backlight is an important feature of the present invention.

The two main elements of the present invention (push button assembly and cylinder assembly) can be impregnated or seal-coated in any fashion that allows free motion of the push button assembly within the cylinder. This permits applications that currently require expensive and often cumbersome sealed switches.

BRIEF DESCRIPTION OF THE SEVERAL VIEWS OF THE DRAWING

FIG. 1 shows a top view of an embodiment of the switch assembly.

FIG. 2 shows a side view of an embodiment of the switch assembly, with a preferred mounting means.

FIG. 3 shows a sectional view of FIG. 2, without showing the preferred mounting means.

DETAILED DESCRIPTION OF THE INVENTION

Figure 4:
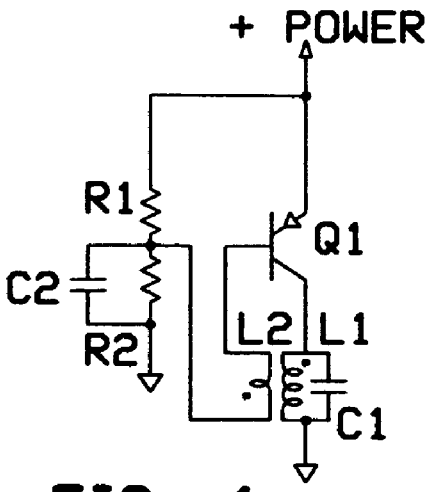
FIG. 4 shows the circuit diagram of a common well-known oscillator circuit.

FIG. 1 is a top view of an embodiment of the present invention showing a push button assembly 1 and a cylinder assembly 2, with the push button assembly shown assembled with the cylinder assembly for clarity. The push button assembly has a push button 4 and a shaft 3. The cylinder assembly shows: a circuit board 7 with a three-pin connector 8; a ferromagnetic ring 6 encircling the cylinder body 5; wire coils 9 which electrically attach to the circuit board.

FIG. 2 is a side view of an embodiment of the present invention with added details: The Hall-effect solid state device 10 is shown attached to the underside of the circuit board 7; the circuit board attachment means 11 and 24, which are bonded to the circuit board and to the cylinder body with a suitable conventional adhesive.

The push button assembly is prevented from rotating within the cylinder assembly by guide pin 12 which protrudes through the shell of the cylinder assembly into a longitudinal groove in the piston assembly.

A preferred mounting means for an embodiment of the present invention includes: a steel strip 22 bonded to a backplane 23; and a front panel 21.

The pins of the three-pin connector 8 pass through the backplane to be connected to circuit connections thereon, while the steel strip attracts and holds the cylinder assembly 5 by the magnetic force of a magnet which is a part of the cylinder assembly.

Connection to the backplane is the only attachment required. The front panel 21 has a clearance hole for the cylinder body preventing lateral and/or vertical motion of the cylinder. The force applied to the operation of the push button switch is directed into the backplane.

FIG. 3 is a sectional view of an embodiment of the present invention with the push button assembly shown in its magnetically stable resting position.

The push button assembly is comprised of a push button body 20 fastened or bonded to a shaft 3. The push button body is typically made of a rigid non-metallic material by molding or other fabricating process. The shaft is made of a rigid non-metallic material suitable for the intended application of the push button switch, has an elongated groove 14, and contains a fixed permanent magnet 13 at its rear. Guide pin 12 in the cylinder 5 and the groove in the shaft comprise the means to prevent shaft rotation within the cylinder while allowing free longitudinal movement. An elongated coil wound on a ferromagnetic core 15 is electrically connected to a pair of LEDs 16.

The push button is comprised of the push button body 20, a transparent face plate 19, and a message medium 18, which displays text or symbols which are seen through the transparent face plate. The message medium is backlighted by LEDs in the shaft. In an alternative embodiment of the present invention, the message medium is an active display device with the requisite electronic drivers contained in the shaft assembly, powered by the coil in the shaft and programmed via pulse modulation of the power source.

The cylinder assembly is comprised of a cylinder body 5 made of a rigid non-metallic material suitable for the intended application of the push button switch. The cylinder body contains a fixed permanent magnet 17 at its rear, the magnetic polarity of which opposes the magnetic polarity of the shaft magnet 13. Circuit board 7 is fastened or bonded to the cylinder using mounts 11 and 24. The circuit board contains circuits and components for switching, power source, control functions, and a solid state Hall-effect device 10.

A ferromagnetic ring 6, bonded or fastened to the cylinder body 5, attracts the push button assembly magnet 13, holding the push button assembly at a magnetically stable position until the push button is depressed. The mutual magnetic attraction of the ferromagnetic ring 6 and the magnet 13 tend to resist depression of the push button assembly, thus providing a tactile resistance force. The ferromagnetic ring as shown is a preferred embodiment of the present invention; however, the ring may take various configurations which meet the intent of the ring as shown: for example, it could be a coil of square cross section iron wire.

Permanent magnet 17 is attached to the cylinder body 5 with its magnetic polarity in opposition to the magnetic polarity of the push button assembly magnet 13 which opposes the push button magnet 13 with increasing force as the two magnets are forced toward one another, thus limiting the depressed travel of the push button, at the same time providing a restoring force to return the push button assembly to a magnetically stable location when the push button pressure is released.

FIG. 4 shows a simple oscillator configuration, a transistorized version of a tuned plate oscillator circuit from the vacuum tube era. Resistors R1 and R2 and capacitor C1 provide the base bias current; coil L2 provides positive feedback current coupled from the resonant circuit (coil L1 and capacitor C1). The oscillator circuit operation is familiar to those skilled in the art, and it is obvious that an NPN transistor circuit can be substituted for the PNP transistor circuit shown without altering the intent of the present invention. Distortion of the oscillator waveform is irrelevant in the performance of the present invention.

Figure 5:
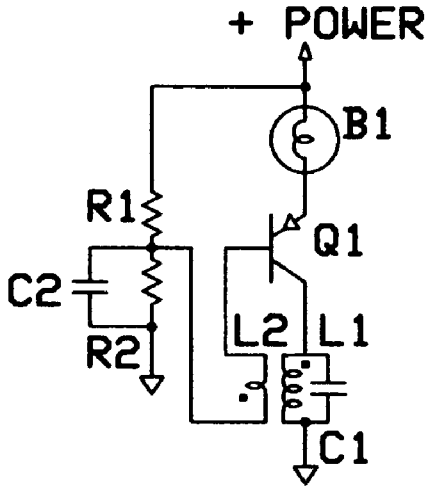
FIG. 5 shows a modification of the FIG. 4 circuit, adding a current regulator in accordance with the present invention.

FIG. 5 shows the oscillator of FIG. 4 with the addition of a low voltage, low power tungsten filament lamp B1 into the transistor Q1 emitter current path. The non-linear rapid increase in resistance of the filament vs. linear increase of current is a well-known characteristic of tungsten filament lamps and has been exploited since early radio era for controlling current. An excellent example of this type of application is taught by W. R. Hewlett in his U.S. Pat. No. 2,268,872, 1/1942. The Hewlett patent uses the lamp to control negative feedback in a vacuum tube oscillator to preserve the purity of sine wave generation.

The present invention uses a tungsten filament lamp B1 to limit the oscillator current and thereby limit the current induced in a coupled secondary coil connected to an LED load. The LED current may be limited to less than the rated current to increase reliability.

A further advantage of the tungsten filament lamp is to act as a self-resetting fuse. The use of an incandescent lamp will limit maximum circuit failure current to the lamp operating current, thus avoiding or limiting collateral damage.

Figure 6:
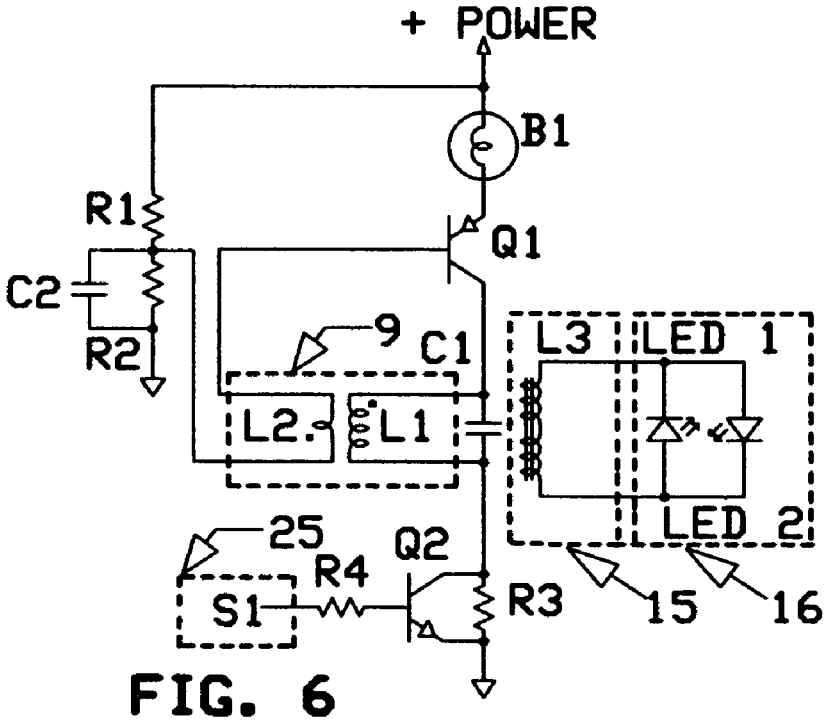
FIG. 6 shows a modification of the FIG. 5 circuit, adding a power control switch in accordance with the present invention and showing the addition of a coupled secondary coil connected to a pair of LEDs.

FIG. 6 shows the oscillator circuit of FIG. 5 with the addition of a secondary coil L3 electrically connected to LED 1 and to LED 2, and a power-dissipating resistor R3 shunted by transistor Q2.

Secondary coil L3 is wound on a ferromagnetic core and the assembly is inductively coupled to resonant circuit coil L1. LED 1 and LED 2 are reverse-parallel connected in the well-known manner of A.C.-driven LEDs. An example of this type of connection is taught by Yasuo Okuno, U.S. Pat. No. 4,298,869, 11/1981.

Resistor R3 is in series with the current path of the transistor Q1, but it can be by-passed by transistor Q2 when Q2 is driven to a conducting state by the application of base current by power control S1.

Resistor R3 dissipates enough power due to the flow of oscillator transistor current that the resultant voltage drop starves the oscillator beyond the ability of the lamp B1 to have meaningful control of the oscillator current. The starved oscillator continues to oscillate with a low current level in the resonant circuit L1/C1. The power level of the oscillator is then essentially determined by the resistance of R3. The lowered resonant circuit current results in less current flowing in the LEDs, causing them to dim.

In the preferred embodiment of the present invention power control S1 forces bypass transistor Q2 to conduct when the push button switch is in the ON state, and not to conduct when the push button switch is in the OFF state. The result is that LED 1 and LED 2 are brighter when the switch is ON.

A preferred embodiment of FIG. 6 components places them on circuit board 7 of FIG. 3, except: coils L1 and L2 are shown as the wire coils 9 wound on the cylinder assembly body 5 ; the secondary coil L3 with its ferromagnetic core is shown as element 15; LED 1 and LED 2 are shown as element 16.

Figure 7:
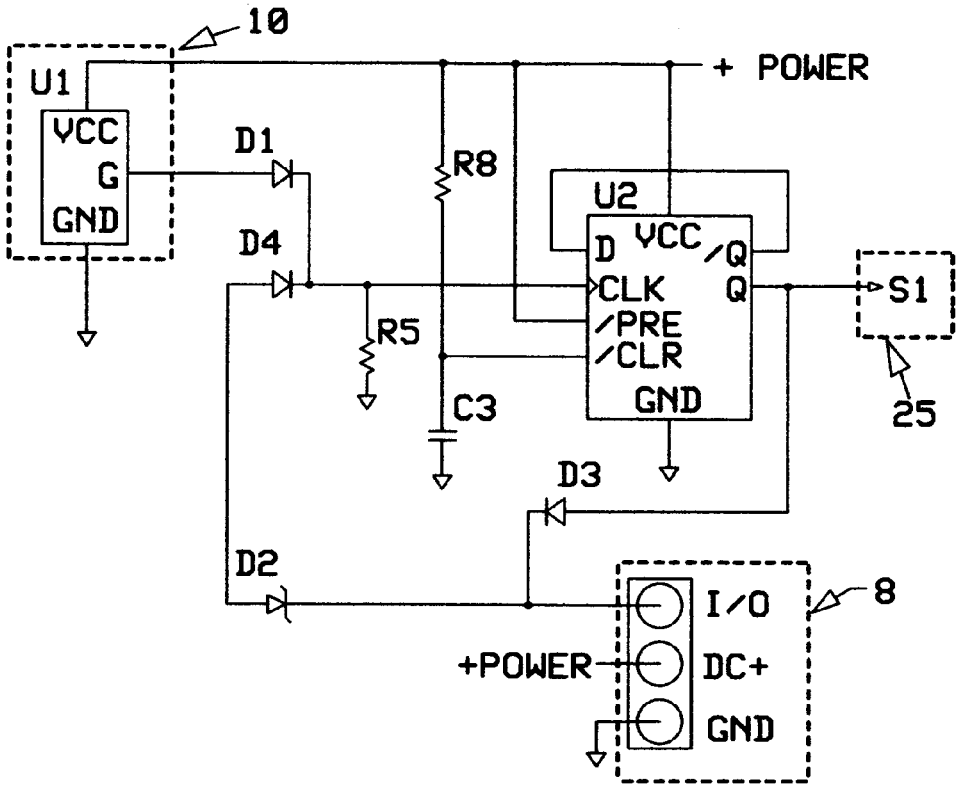
FIG. 7 shows a common bistable logic device connected to a Hall-effect solid state device and a resistor/diode arrangement in accordance with the present invention.

FIG. 7 shows a preferred circuit for the bi-stable logic element U2, a magnetically operated Hall-effect switch U1, and the diode logic according to the present invention that results in combined one-wire switch-state output and remote-control input of the push button switch assembly.

The bi-stable logic device U2, a commodity item available from various vendors, has its inverted output /Q connected to its data input D, resulting in a well-known alternate action wherein the logic output Q changes its logic state each time the clock input CLK receives a positive-going electrical pulse. The logic output Q is connected to the I/O pin on the interface connector 8, with isolation diode D3 in series with the logic output. The logic output S1 is directly connected to resistor R4 of FIG. 6.

A first source of a positive-going electrical pulse is Hall-effect device U1, a commodity item available from various vendors, which has a logic output G connected to isolating diode D1. In a preferred embodiment of the present invention a permanent magnet located in the push button assembly produces a magnetic field by which the Hall-effect device is switched to its ON state resulting in the G output being driven to GND potential. Operating the push button assembly by depressing the push button alters the magnetic field with respect to the Hall-effect device to cause the Hall-effect device to switch to its OFF state resulting in a high state logic output, raising the anode of isolation diode D1 to a positive voltage causing the diode to conduct and apply a positive-going voltage to clock input CLK.

A second source of a positive-going electrical pulse is the application of an external positive voltage to pin I/O of the interface connector 8 sufficiently high in potential to pass through the zener diode D2 and isolation diode D4 to apply a positive-going voltage to clock input CLK. Resistor R5 provides a drain to GND to avoid any leakage voltage from accumulating at the clock input CLK. Isolation diodes D3 and D1 block the external positive voltage applied to pin I/O and the zener diode D2 blocks the ON state positive voltage at output Q from the clock input CLK.

Capacitor C3 momentarily holds the clear input /CLR of the bi-stable device U2 at or near GND potential to assure that U2 is switched to the OFF state when power is first applied to the push button switch assembly. Resistor R8 rapidly charges capacitor C3 to the voltage level of power source +POWER to disable the /CLR function; R8 also discharges capacitor C3 at power-down. The preset input /PRE is connected to the power source +POWER to disable the unused /PRE input.

Bi-stable device U2 responds quickly enough to an external positive control voltage applied to the interface connector 8 pin I/O that a pulse code modulated signal may be applied at the control input and be recovered at the coil 15 in the push button assembly shaft as a current level change of the current supplied to the LEDs 16. The pulse transmission could be perceived as a slight flicker of the LED intensity; however, the duration of a control code transmission would be no more than a few milliseconds.

The unique features of the present invention are claimed as follows:

1. A push-button switch comprised of two loosely nested hollow cylinders where the moveable inner cylinder supports a concentrically attached cylindrical push-button, a passive backlighted display viewable through a transparent faceplate of the push-button, a permanent magnet, and a coil for induction-coupled power for the display backlighting; and where the stationary outer cylinder supports an oscillator circuit and coils to inductively couple power to the inner cylinder, a Hall-effect switch activated by the magnet in the inner cylinder when the push-button is depressed, and a permanent magnet to provide a restoring force for when the push-button is released, wherein the outer cylinder supports a printed circuit board containing the Hall-effect switch connected to a bi-stable latch circuit arranged to provide alternate-action switching at each push-button depression and where the bi-stable latch circuit is connected to an input/output pin of a connector.

2. The push-button switch of claim 1 wherein the inner cylinder display is a translucent medium imprinted with text or graphics mounted to the backside of the transparent faceplate of the push-button, and is backlighted by LEDs electrically connected to a coil wound on a ferromagnetic core located within the inner cylinder.

3. The push-button switch of claim 1 wherein the oscillator circuit output power level is modified by a bistable latch circuit connected to the Hall-effect switch.

4. The push-button switch of claim 1 wherein the oscillator circuit contains a tungsten filament lamp connected to limit the oscillator output current.

5. The push-button switch of claim 1 wherein an outer cylinder pin protrudes into an inner cylinder longitudinal groove to limit relative rotational movement.

6. The push-button switch of claim 1 wherein a ferromagnetic ring encircling and attached to the outer cylinder is positioned to attract the inner cylinder magnet and cylinder to a defined relative location.

7. The push-button switch of claim 1 wherein the logic state of a bistable latch connected to the Hall-effect switch is changed by application of an external electrical pulse to an input/output pin of a connector.

8. A push-button switch comprised of two loosely nested hollow cylinders where the moveable inner cylinder supports a concentrically attached cylindrical push-button, an electroluminescent display viewable through a transparent faceplate of the push-button, a permanent magnet, and a coil for induction-coupled power and control signals for the display; and where the stationary outer cylinder supports an oscillator circuit and coils to inductively couple power and control signals to the inner cylinder, a Hall-effect switch activated by the magnet in the inner cylinder when the push-button is depressed, and a permanent magnet to provide a restoring force for when the push-button is released, wherein the outer cylinder supports a printed circuit board containing the Hall-effect switch connected to a bi-stable latch circuit arranged to provide alternate-action switching at each push-button depression and where the bi-stable latch circuit is connected to an input/output pin of a connector.

9. The push-button switch of claim 8 wherein the inner cylinder display is an electroluminescent display mounted to the backside of the transparent faceplate of the push-button with the requisite power and control circuits electrically connected to a coil wound on a ferromagnetic core located within the inner cylinder.

10. The push-button switch of claim 8 wherein the oscillator circuit output power level is modified by a bistable latch circuit connected to the Hall-effect switch.

11. The push-button switch of claim 8 wherein the oscillator circuit contains a tungsten filament lamp connected to limit the oscillator output current.

12. The push-button switch of claim 8 wherein an outer cylinder pin protrudes into an inner cylinder longitudinal groove to limit relative rotational movement.

13. The push-button switch of claim 8 wherein a ferromagnetic ring encircling and attached to the outer cylinder is positioned to attract the inner cylinder magnet and cylinder to a defined relative location.

14. The push-button switch of claim 8 wherein the logic state of a bistable latch connected to the Hall-effect switch is changed by application of an external electrical pulse to an input/output pin of a connector.

* * * * *